US011227540B2

(12) United States Patent
Lee et al.

(10) Patent No.: US 11,227,540 B2
(45) Date of Patent: Jan. 18, 2022

(54) DISPLAY DEVICE

(71) Applicant: Samsung Display Co., LTD., Yongin-si (KR)

(72) Inventors: Jeong In Lee, Jeollanam-do (KR); Dong Hyun Lee, Asan-si (KR); Hyun A Lee, Seoul (KR); Byoung Yong Kim, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/095,806

(22) Filed: Nov. 12, 2020

(65) Prior Publication Data

US 2021/0142718 A1 May 13, 2021

(30) Foreign Application Priority Data

Nov. 13, 2019 (KR) ..... 10-2019-0145117

(51) Int. Cl.
*G09G 3/32* (2016.01)

(52) U.S. Cl.
CPC ..... *G09G 3/32* (2013.01); *G09G 2300/0408* (2013.01)

(58) Field of Classification Search
CPC ..... G09G 2300/0408; G09G 3/32
See application file for complete search history.

(56) References Cited

U.S. PATENT DOCUMENTS

2011/0149198 A1* 6/2011 Kim ..... G02F 1/133308 349/58
2015/0003040 A1* 1/2015 Bessho ..... F21V 9/40 362/84
2016/0197020 A1* 7/2016 Lim ..... H01L 23/66 257/48
2018/0267353 A1* 9/2018 Takeda ..... G06F 3/0446
2019/0109288 A1 4/2019 Li et al.

FOREIGN PATENT DOCUMENTS

JP H10-153790 A 6/1998
JP 2001201727 A 7/2001
KR 1020160020012 A 2/2016
KR 101722292 B1 3/2017

* cited by examiner

*Primary Examiner* — Muhammad N Edun
(74) *Attorney, Agent, or Firm* — Cantor Colburn LLP

(57) ABSTRACT

A display device includes: a substrate including a first surface and a second surface opposing each other; a display element and a signal line on the first surface; a first wire on the second surface and electrically connected to the signal line; a cover portion on the second surface; and a first driving unit on the second surface and electrically connected to the first wire. The first wire includes a portion exposed outside the cover portion, and the first driving unit is connected to the first wire at the portion of the first wire which is exposed outside the cover portion.

20 Claims, 11 Drawing Sheets

DISPLAY DEVICE

This application claims priority to Korean Patent Application No. 10-2019-0145117 filed on Nov. 13, 2019, and all the benefits accruing therefrom under 35 U.S.C. § 119, the entire contents of which are incorporated herein by reference.

BACKGROUND

(a) Field

The present disclosure relates to a display device.

(b) Description of the Related Art

A display device such as a liquid crystal display ("LCD"), an organic light emitting diode ("OLED") display, etc. includes a display panel including a plurality of pixels with which an image is displayed. Each pixel includes a pixel electrode for receiving a data signal, and the pixel electrode may be connected to at least one transistor to receive the data signal.

Signal lines or various voltage lines connected to the pixel may receive electronic driving signals or electronic voltages from a driving circuit unit. The driving circuit unit may be mounted on the display panel in a form of a driving circuit chip or mounted on a printed circuit board ("PCB") connectable to the display panel.

SUMMARY

The present disclosure provides a display device in which an area of a dead space of the display device is reduced and for which a degradation of a display element of a display area of the display device is reduced or effectively prevented.

A display device includes: a substrate including a first surface and a second surface opposing each other; a display element and a signal line on the first surface; a first wire on the second surface and electrically connected to the signal line; a cover portion on the second surface; and a first driving unit on the second surface and electrically connected to the first wire. The first wire includes a portion exposed outside the cover portion, and the first driving unit is connected to the first wire at the portion of the first wire which is exposed outside the cover portion.

The cover portion may include a plurality of layers and an adhesive layer which is between the plurality of layers.

The plurality of layers may include a heat dissipation layer.

The heat dissipation layer may include copper or graphite.

The adhesive layer may include an outer surface which is closest to the substrate and has an embossed shape.

The substrate may include a display area in which the display element is provided, and a peripheral area adjacent to the display area and in which the signal line is provided. The cover portion may correspond to both the display area and the peripheral area.

The display device may include an enclosed opening and the portion of the first wire may be exposed outside the cover portion at the enclosed opening in the cover portion.

The enclosed opening in the cover portion may have a planar size defined along the second surface of the substrate, and the first driving unit may include a driving circuit chip which has a planar size smaller than the planar size of the opening.

The substrate may include a side surface which connects the first surface to the second surface, and in a direction along the second surface of the substrate, the cover portion may include an edge which is spaced apart from the side surface of the substrate with the portion of the first wire therebetween.

The first driving unit may be a driving circuit chip, and in the direction along the second surface of the substrate, an entirety of the driving circuit chip may be between the side surface of the substrate and the edge of the cover portion.

The display device may include a second wire on the second surface and spaced away from the first wire, and a second driving unit on the second surface and electrically connected to the second wire. The second wire may include a portion exposed outside the cover portion, and the second driving unit may be connected to the second wire at the portion of the second wire which is exposed outside the cover portion.

The second driving unit may be a flexible printed circuit film.

The display device may include an enclosed opening defined in the cover portion. The portion of the second wire may be exposed outside the cover portion at the enclosed opening in the cover portion.

The substrate may include a side surface which connects the first surface to the second surface, and in a direction along the second surface of the substrate, the cover portion may include an edge which is spaced apart from the side surface of the substrate with the portion of the first wire and the portion of the second wire therebetween.

The second driving unit may extend from the portion of the second wire to overlap the cover portion.

The substrate may include a display area in which the display element is provided, a peripheral area adjacent to the display area and in which the signal line is provided, and an end portion of the peripheral area in which an opening in the substrate is defined. The first wire may be electrically connected to the signal line at the opening in the substrate at the end portion of the peripheral area.

A display device includes: a substrate including a first surface and a second surface opposing each other; a light-emitting element and a signal line on the first surface; a first wire on the second surface and electrically connected to the signal line; a cover portion on the second surface and corresponding to the light-emitting element on the first surface; and a first driving unit on the second surface and electrically connected to the first wire. The first wire includes a portion exposed outside the cover portion, and the first driving unit is connected to the first wire at the portion of the first wire which is exposed outside the cover portion.

The display device may include an enclosed opening defined in the cover portion. The portion of the first wire may be exposed outside the cover portion at the enclosed opening in the cover portion.

The substrate may include a side surface which connects the first surface to the second surface, and in a direction along the second surface of the substrate, the cover portion may include an edge which is spaced apart from the side surface of the substrate with the portion of the first wire therebetween.

A display device includes: a substrate including a first surface and a second surface opposing each other; a light-emitting element and a signal line on the first surface; a first wire on the second surface and electrically connected to the signal line; a cover portion on the second surface, the cover portion including copper or graphite; and a first driving unit disposed on the second surface and electrically connected to the first wire. The first wire includes a portion exposed outside the cover portion including copper or graphite, and the first driving unit is connected to the first wire at the portion of the first wire which is exposed outside the cover portion copper or graphite.

According to one or more embodiment, a planar area of the dead space within the display device may be reduced and the deterioration of the display element in a display area of the display device may be reduced or effectively prevented.

BRIEF DESCRIPTION OF THE DRAWINGS

The above and other advantages and features of this disclosure will become more apparent by describing in further detail embodiments thereof with reference to the accompanying drawings, in which.

DETAILED DESCRIPTION

Figure 1:
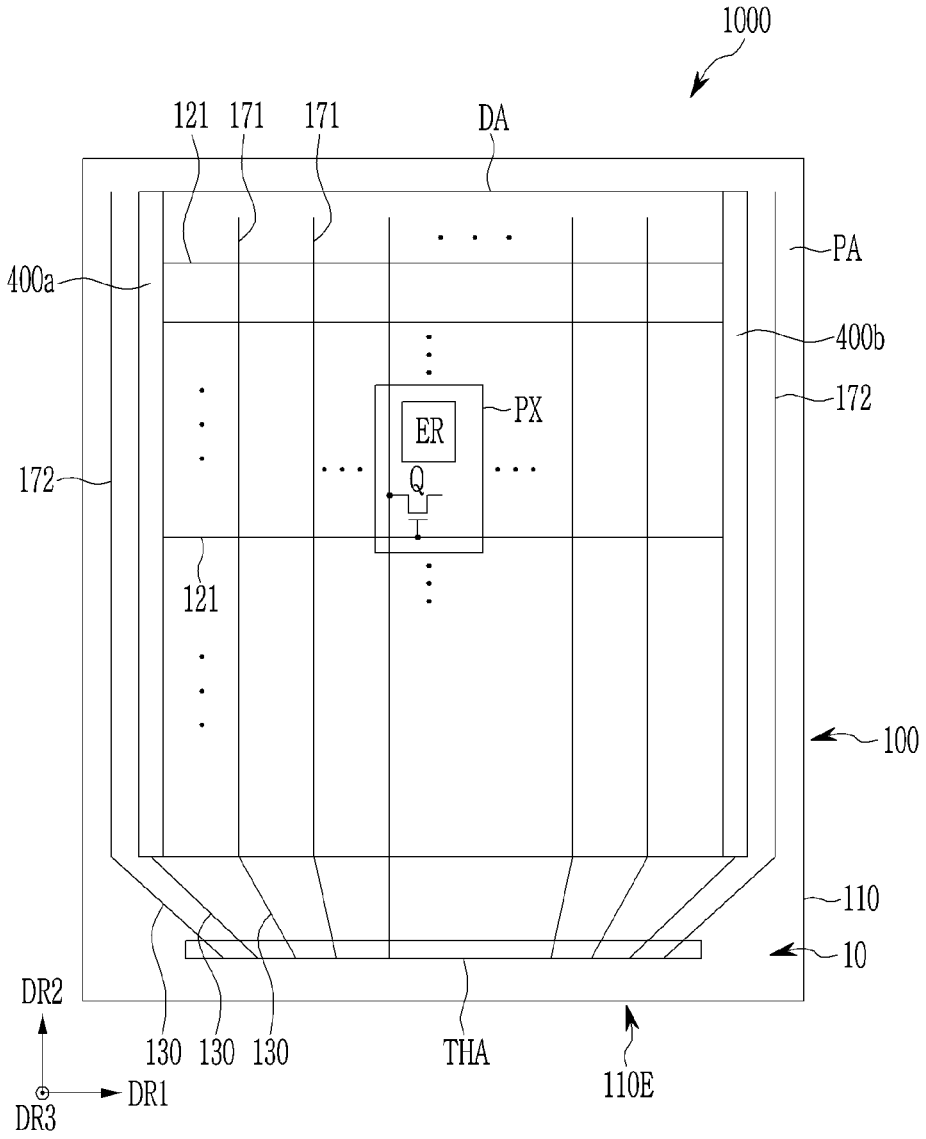
FIG. 1 is a top plan view of an embodiment of a display device.

The invention will be described more fully hereinafter with reference to the accompanying drawings, in which embodiments of the invention are shown. As those skilled in the art would realize, the described embodiments may be modified in various different ways, all without departing from the spirit or scope of the invention.

For clarity of description of the invention, parts unrelated to description are omitted, and the same reference numbers will be used throughout this specification to refer to the same or like parts.

Further, in the drawings, size and thickness of each element are arbitrarily illustrated for ease of description, and the invention is not necessarily limited to those illustrated in the drawings. In the drawings, the thickness of layers, films, panels, regions, etc., are exaggerated for clarity. In the drawings, for ease of description, the thicknesses of some layers and regions are exaggerated.

It will be understood that when an element such as a layer, film, region, or substrate is referred to as being related to another element such as being "on" another element, it can be directly on the other element or intervening elements may also be present. In contrast, when an element is referred to as being related to another element such as being "directly on" another element, there are no intervening elements present. Further, in the specification, the word "on" or "above" means positioned on or below the object portion, and does not necessarily mean positioned on the upper side of the object portion based on a gravitational direction.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. In addition, unless explicitly described to the contrary, the word "comprise" and "include" and variations such as "comprises" or "comprising" will be understood to imply the inclusion of stated elements but not the exclusion of any other elements.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Throughout this specification, a plan view (or top plan view) means a view of a surface parallel to two directions (e.g., a first direction DR1 and a second direction DR2) crossing each other, and a cross-sectional view means a view of a surface along a direction (e.g., a third direction DR3) which crosses each of the first direction DR1 and the second direction DR2. The third direction DR3 may otherwise be referred to as a thickness direction. The third direction DR3 may be perpendicular to the surface which is disposed in plane defined by the first direction DR1 and the second direction DR2, without being limited thereto. Also, to overlap two constituent elements means that two constituent elements are overlapped along the third direction DR3 unless stated otherwise.

A display device according to one or more embodiment is described with reference to FIG. 1 to FIG. 4.

Figure 2:
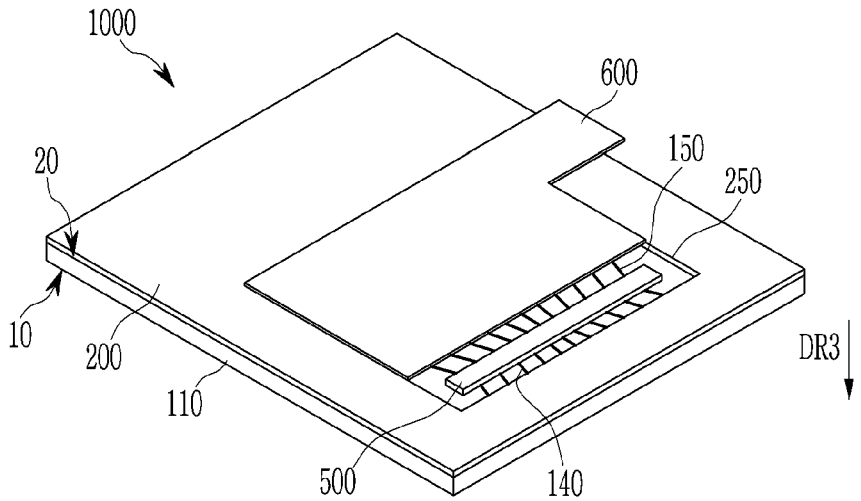
FIG. 2 is a perspective view of an embodiment of a display device.
Figure 3:
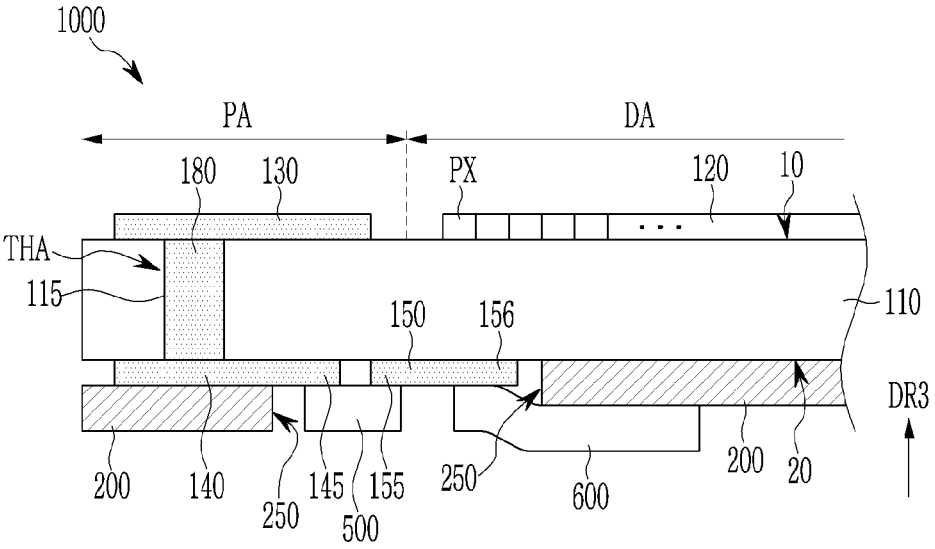
FIG. 3 is a cross-sectional view of an embodiment of an end portion of a display device.
Figure 4:
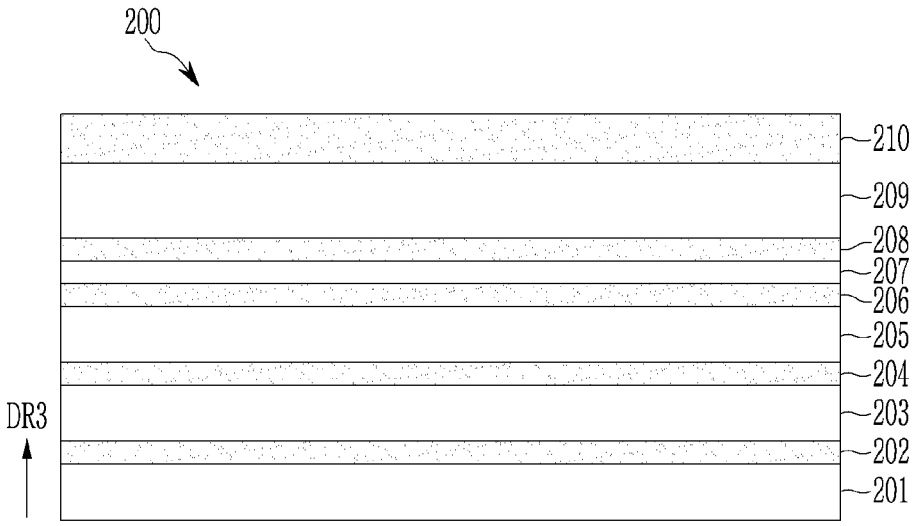
FIG. 4 is an enlarged cross-sectional view of an embodiment of a cover portion of a display device.

FIG. 1 is a top plan view of an embodiment of a display device 1000, FIG. 2 is a perspective view of an embodiment of a display device 1000, FIG. 3 is a cross-sectional view of an embodiment of an end portion of a display device 1000, and FIG. 4 is an enlarged cross-sectional view of an embodiment of a cover portion 200 of a display device 1000.

Referring to FIG. 1, a display device 1000 includes a display panel 100 including a display area DA and a peripheral area PA which is disposed adjacent to, such as outside of the display area DA. Various components of the display device 1000 may include a display area DA and a peripheral area PA corresponding to the display area DA and the peripheral area PA described above for the display device 1000.

Referring to FIG. 1, FIG. 2, and FIG. 3, the display panel 100 includes a substrate 110 including a first surface 10 and a second surface 20 which is opposite to the first surface 10.

The display area DA is a planar area in which an image is displayed. The image may be displayed according to one or more electronic signals applied to a component in the display area DA, such as an input image signal. Within the display area DA, a pixel PX provided in plural (e.g., a plurality of pixels PX), a gate line 121 provided in plural (e.g., a plurality of gate lines 121), and a data line 171 provided in plural (e.g., a plurality of data lines 171), may be disposed.

The pixel PX is a basic unit for displaying the image. The pixel PX may be a portion of the display panel 100 at which light is generated and/or emitted for displaying the image. Each one of the pixel PX among a plurality of pixels PX, may include a pixel circuit including at least one transistor Q (e.g., switching element) and a display unit ER for generating and/or emitting light for displaying the image. The display unit ER may be connected to and driven by the pixel circuit, to generate light, emit light, display the image, etc.

At least one pixel electrode may be disposed in the display unit ER. The pixel electrode may be electrically connected directly to the transistor Q or indirectly through another electrical element. The display unit ER, for example, may include the pixel electrode, a common electrode, and a display element disposed between the pixel electrode and the common electrode. The display element may include a light emitting diode ("LED") including an emission layer, without being limited thereto.

The plurality of pixels PX may be regularly arranged, for example, arranged in a matrix form, within the display area DA.

In order to represent various colors, each pixel PX may generate, emit and/or display light of one color among primary colors. The image of a desired color may be recognized by a spatial and temporal sum of these primary colors. The primary colors may include, for example, three primary colors such as red, green and blue, and may include white.

The gate line 121 may transmit an electrical signal such as a gate signal including a gate-on voltage and a gate-off voltage, to a gate terminal of the transistor Q of the pixel PX. The plurality of gate lines 121 may be arranged substantially parallel to each other, such as parallel to the second direction DR2. Each of the gate lines 121 may extend substantially along the first direction DR1. Each of the gate lines 121 may define a length thereof extended along the first direction DR1.

The data line 171 may transmit an electrical signal such as a data voltage corresponding to the input image signal, to a source terminal of the transistor Q of the pixel PX. The plurality of data lines 171 may be arranged substantially parallel to the first direction DR1. Each of the data lines 171 may extend substantially along the second direction DR2. Each of the data lines 171 may define a length thereof extended along the second direction DR2.

The transistor Q of the pixel PX may be turned on or turned off according to the gate signal transmitted from the gate line 121 to receive the data voltage from the data line 171. A pixel voltage corresponding to the data voltage is applied to the pixel electrode, so that the display unit ER of each pixel PX may generate the light, emit the light and/or display the image.

Referring to FIG. 3, the pixel PX, the gate line 121, and the data line 171 may be disposed in a layer 120 disposed on the first surface 10 of the substrate 110. The layer 120 may be a single layer, without being limited thereto. Thicknesses of the pixel PX, the gate line 121 and the data line 171 may each be within a total thickness of the layer 120, along the third direction DR3. The layer 120 may otherwise be referred to as a display layer or display element layer.

The peripheral area PA may be an area that mostly does not generate light, emit light and/or display the image. The peripheral area PA may be a planar area adjacent to the display area DA. In an embodiment, for example, the peripheral area PA may surround the display area DA in the top plan view. The peripheral area PA in which an image is not displayed may be referred to as dead space or a non-display area.

A voltage line 172, a driving signal line, a circuit, etc. may be disposed in the peripheral area PA. One or more of these elements may be connected to an element within the display area DA, such as an element within the pixel PX. FIG. 1 illustrates driving units 400*a* and 400*b* (e.g., drivers 400*a* and 400*b*) and a voltage line 172 disposed in the peripheral area PA as an example.

FIG. 1 illustrates an example that the driving units 400*a* and 400*b* are respectively disposed at the left and right portions of the peripheral area PA (e.g., peripheral areas PA), with respect to the display area DA. That is, the driving units 400*a* and 400*b* are disposed facing each other with the display area DA therebetween. The driving units 400*a* and 400*b* may include a gate driving circuit connected to the gate line 121 and from which the gate signal is transmitted. The gate driving circuits of the drivers 400*a* and 400*b* in the peripheral area PA may be provided or formed on the first surface 10 of the substrate 110 together with the transistor Q of the pixel PX positioned in the display area DA. In an embodiment, one of the driving units 400*a* and 400*b* may be omitted.

The voltage line 172 may include a portion extending along a circumference (e.g., an outer edge or boundary) of the display area DA. The voltage line 172 may be provided or formed on the first surface 10 of the substrate 110.

The peripheral area PA of the substrate 110 may include or define a through part THA, positioned between an edge 110E (or a side surface) of the substrate 110 and the display area DA. The edge 110E of the substrate 110 may extend substantially parallel to the first direction DR1. The side surface at the edge 110E may be parallel to a plane defined by the first direction DR1 and the third direction DR3, without being limited thereto.

The data line 171, the voltage line 172 and a driving signal line connected to the driving units 400*a* and 400*b*, may include a wire 130 (e.g., first wire) of which a portion thereof is disposed in the through part THA or may be connected to the wire 130. That is, the data line 171, the voltage line 172, and the driving signal line connected to the driving units 400*a* and 400*b* as elements on the first surface 10, may electrically extend to the through part THA, by including or being connected to the wire 130. The wire 130 may be located in the peripheral area PA. The wire 130 may extend from the peripheral area PA into the display area DA or from one portion of the peripheral area to a different portion of the peripheral area PA. In an embodiment, the wire 130 at the first surface 10 may connect the peripheral area PA to the display area DA, such that electrical signals may be provided from outside the display panel 100, through the peripheral area PA, and to the display area DA. The wire 130 may connect different portions of the peripheral area PA to each other such that electrical signals may be provided from outside the display panel 100, through a first region of the peripheral area PA and to a second region of the peripheral area PA. As used herein, a wire 130 (or a wire 140 or a wire 150) may otherwise be referred to as a conductive wire, a signal wire, a conductive signal wire, etc. The wire 130 may be provided in plural (e.g., wires 130) on the substrate 110.

On the first surface 10 of the substrate 110, the wire 130 in the peripheral area PA, may be disposed in a same layer as or in different layers from the data line 171 disposed in the display area DA, the voltage line 172 positioned in the left and right peripheral areas PA of the display area DA, and other driving signal lines.

As being in a same layer, elements may be respective portions of a same material layer on the substrate 110, thicknesses of elements of a same layer may be within a total thickness of the same layer measured from a surface of the substrate 110, elements may be disposed at a same distance from the substrate 110 along the third direction DR3 (e.g., along a thickness direction of the substrate 110), etc.

Referring to FIG. 3, the substrate 110 may include an opening 115 penetrating the substrate 110 along the third direction DR3 at the through part THA. Portions of the substrate 110 may define the opening 115. The opening 115 may be open to outside the substrate 110 at both the first surface 10 and the second surface 20. That is, the opening 115 may be disposed at the through part THA.

A connection portion 180 having electrical conductivity may be disposed in the opening 115. The wire 130 disposed on the first surface 10 of the substrate 110 and outside of the opening 115, may be in contact with and electrically connected to the connection portion 180 at the opening 115 and/or the through part THA.

A wire 140 (e.g., second wire) may be disposed on the second surface 20 of the substrate 110 and outside of the opening 115, to be in contact with and electrically connected to the connection portion 180 at the opening 115 and/or the through part THA. Accordingly, the wire 130 may be electrically connected to the wire 140 through the connection portion 180. The wire 140 may be provided in plural (e.g., wires 140) on the substrate 110.

The connection portion 180 may include the wire 130 or the wire 140 (or a portion thereof), may include a conductive material different from the wire 130 or the wire 140, or may include the same conductive material as the wire 130 and/or the wire 140. In an embodiment of manufacturing a display device 1000, when the connection portion 180 includes a same conductive material as the wire 130 or the wire 140, the connection portion 180 may be simultaneously provided or formed when the wire 130 or the wire 140 is provided or formed. In this case, a boundary line between the connection portion 180 and the wire 130 or the wire 140 shown in FIG. 3 may not be visible. That is, the connection portion 180, together with a portion of the wire 130 and/or the wire 140, may form a single unitary body without an interface therebetween at a boundary line. In an embodiment, the wire 130 outside of the substrate 110 at the first surface 10 thereof, may extend into the opening 115 to be disposed in the opening 115. Similarly, the wire 140 outside of the substrate 110 at the second surface 20 thereof may extend into the opening 115 to be disposed in the opening 115. Conversely, in an embodiment, the connection portion 180 in the opening 115 may extend outside of the opening 115 to be disposed outside of the substrate 110 at the first surface 10 and/or the second surface 20.

Referring to FIG. 2 and FIG. 3, a wire 150 (e.g., third wire) may be disposed on the second surface 20 of the substrate 110. The wire 150 may be spaced apart from the wire 140 along the substrate 110. A portion of the wire 150 may be connected to the wire 140. A portion of one among the wire 150 and the wire 140 may define the other one among the wire 150 and the wire 140. The wire 150 may include a same material as the wire 140 or may include a different material from the wire 140. In an embodiment of manufacturing a display device 1000, when the wire 150 includes a same conductive material as the wire 140, the wire 150 may be simultaneously provided or formed when the wire 140 is provided or formed. The wire 150 may be provided in plural (e.g., wires 150) on the substrate 110.

A cover portion 200 is disposed on the wire 140 and the wire 150 (which means a lower side of the wire 140 and the wire 150 in the drawing and is the same later). The cover portion 200 may be in a form of a composite film (e.g., film-type) or a panel (e.g., panel-type) including at least one film or layer having heat dissipation and impact resistance characteristics.

Referring to FIG. 4, for example, the cover portion 200 may include a plurality of layers 201 to 210. The plurality of layers 201 to 210 may include at least one heat dissipation layer and an adhesive layer.

In an embodiment, for example, the layer 201 may include a metal which transfers heat (e.g., heat transfer layer with a heat transfer rate which allows heat to be transferred relatively easily) such as copper (Cu), the layer 203 may include graphite, at least one of the layers 205 and 207 may include a plastic such as polyimide ("PI") or polyethylene terephthalate ("PET"), and the layer 209 may include a cushioning material to define a cushioning layer. In an embodiment, more specifically, the layer 205 may include polyimide and the layer 207 may include PET. The layer 207 may include PET which is printed and has a black color. The layer 209 including the cushioning material may include, for example, a sponge, a polyurethane foam, or the like, and may effectively absorb heat and quickly discharge the heat. The positions of these layers 201, 203, 205, 207, and 209 may be interchanged, and at least some layers 201, 203, 205, 207, and 209 may be omitted or the materials may vary within the cover portion 200. In addition, at least two of the plurality of layers 201, 203, 205, 207, and 209 may include one layer including the material of the corresponding layers.

The layers 202, 204, 206, 208, and 210 disposed respectively between the layers 201, 203, 205, 207, and 209 described above may include an adhesive material to define an adhesive layer. In an embodiment, for example, the layers 202, 204, 206, 208, 210 may include a pressure sensitive adhesive ("PSA"). The layers 202, 204, 206, 208 and 210 are collectively referred to as adhesive layers.

The layer 210 as an outermost layer within the cover portion 200 may have an embossed shape at an outer surface of the layer 210. Among the various layers of the cover portion 200, the layer 210 within the cover portion 200 may be the layer closest to the substrate 110 shown in FIG. 3. That is, the cover portion 200 may be attached to the second surface 20 of the substrate 110 through the layer 210.

Referring to FIG. 2 and FIG. 3, the cover portion 200 has an opening 250 exposing at least a portion of the wire 140 and the wire 150. The opening 250 may be an enclosed opening which defined by portions of the cover portion 200. A portion of the second surface 20 of the substrate 110 is exposed to outside the cover portion 200 at the opening 250 defined therein. The cover portion 200 of a display device 1000, as shown in FIG. 2 and FIG. 3, may have a single one of the opening 250 or may have the opening 250 provided in plural (e.g., a plurality of openings 250). The opening 250 may be surrounded by the remaining portion of the cover portion 200, such that portions of the cover portion 200 define the opening 250. That is, the opening 250 may be in a form of a hole disposed or defined inside the cover portion 200. The opening 250 may penetrate a thickness of the cover portion 200 along the third direction DR3. A single one of the opening 250 may be common to a plurality of wires 140 and/or wires 150.

The opening 250 of the cover portion 200 may expose at least a portion of the wires 140 and the wires 150, such that the wires 140 and the wires 150 are exposed to outside the cover portion 200 at the opening 250. That is, the cover portion 200 may not overlap at least a portion of the wires 140 and 150. In an embodiment, for example, as shown in FIG. 3, a first end 145 of the wire 140 and a first end of the wire 150 may be exposed outside the cover portion 200 at the opening 250.

The planar shape of the opening 250 may be substantially rectangular as shown in FIG. 2, or may have various other shapes.

The outer edge of the cover portion 200 except for the opening 250 may be substantially coincident with or aligned with the edge 110E of the substrate 110. Accordingly, a total planar area of the cover portion 200 including the planar area of the opening 250 may be substantially the same as a total planar area of the substrate 110.

A driving unit 500 (e.g., first driving unit) may be attached and/or electrically connected to the first end 145 of the wire 140 which is exposed to outside the cover portion 200 at the opening 250. The driving unit 500 may be, for example, in a form of a driving circuit chip, and may include a data driving circuit that generates the data voltage to be applied to the plurality of data lines 171 of the display panel 100.

The driving unit 500 may also be electrically connected to a first end 155 of the wire 150. In this case, the driving unit 500 may also be attached to the first end 155 of the wire 150. A planar area defined by the driving unit 500 overlapping one or more of the wire 150 and one or more of the wire 140, may define an attachment area of the driving unit 500 with respect to the wire 140 and/or the wire 150.

Referring to FIG. 2, a planar size of the opening 250 of the cover portion 200 may be larger than a planar size of the driving unit 500, in a plan view of a rear surface of the display device 1000. That is, the opening 250 in the cover portion 200 has a planar size defined along the second surface 20 of the substrate 110, and the driving unit 500 as a driving circuit chip has a planar size smaller than the planar size of the opening 250.

A driving unit 600 (e.g., second driving unit) may be attached and/or electrically connected to a second end 156 of the wire 150 which is opposite to the first end 155 thereof and exposed to outside the cover portion 200 at the opening 250. The driving unit 600 may be, for example, in a form of a flexible printed circuit film or a printed circuit board ("PCB") and generate the various driving voltages, driving signals, control signals, and the like to be applied to the driving unit 500 and the display panel 100. A planar area defined by the driving unit 600 overlapping one or more of the wire 150 may define an attachment area of the driving unit 600 with respect to the wire 150.

Referring to FIG. 2 and FIG. 3, in the rear view, the driving unit 600 may include a portion overlapping the opening 250 of the cover portion 200 and a portion overlapping the cover portion 200 except for the opening 250. That is, the driving unit 600 may extend along a rear surface of the cover portion 200 and further than an inner sidewall of the cover portion 200 which defines the opening 250, to dispose a portion of the driving unit 600 within the opening 250. A first end of the driving unit 600 may be disposed corresponding to the opening 250.

The cover portion 200 may cover most of the second surface 20 except for a portion at which the driving units 500 and 600 are attached to the wires 140 and 150. That is, the cover portion 200 may overlap most of the display area DA where the plurality of transistors is disposed and the left and right peripheral areas PA. A single one of the cover portion 200 may correspond to the display area DA and the peripheral area PA. The cover portion 200 may contact (e.g., form an interface with) one or more elements on the second surface 20 of the substrate 110, such as the driving units 500 and 600, the wire 140 and the wire 150, without being limited thereto.

The driving units 500 and 600 attached to the display panel 100 at the second surface 20 as the rear surface of the substrate 110 and which generate/provide various electrical signals for driving elements of the display area DA, are electrically connected to the data line 171 of the display area DA, the voltage line 172, the driving units 400*a* and 400*b*, the various other driving signal lines at the first surface 10 of the substrate 110, through the wires 140 and 150 at the second surface 20, together with the connection portion 180 penetrating the substrate 110 and the wire 130 disposed on the first surface 10 of the substrate 110, thereby transmitting the driving signal and the driving voltage (e.g., electrical signals) between elements respectively disposed at the second surface 20 and the first surface 10.

In a conventional display device, a relatively large planar area of the peripheral area PA at the first surface 10 of the substrate 110 of the display panel 100 is provided for attaching the driving unit such as the driving circuit chip or the flexible printed circuit film. As above-described, according to an embodiment, the driving units 500 and 600 such as the driving circuit chip for driving the display panel 100 and the flexible printed circuit film are not attached to the peripheral area PA of the first surface 10 of the substrate 110 as the same surface at which the pixel PX is provided or formed, but are attached on the second surface 20 as the rear surface of the substrate 110. Therefore, different from the prior art, a planar area at which the driving unit such as the driving circuit chip or the flexible printed circuit film is attached is reduced. Therefore, the planar area of the dead space of the display device 1000 according to one or more embodiment may be greatly reduced.

When the driving units 500 and 600 are disposed on the second surface 20 of the substrate 110 as shown in the embodiment, a planar area at which the driving units 500 and 600 and the wires 140 and 150 are attached to each other may be disposed close to or corresponding to the display area DA and/or the driving circuit such as the driving units 400*a* and 400*b* which occupy a planar area at the first surface 10. That is, the driving units 500 and 600 are attached to the wires 140 and 150 at the rear surface of the substrate 110, and an attachment area defined along the second surface 20 corresponds to components at the front surface (e.g., components in the display area DA and/or components like the driving circuit such as the driving units 400*a* and 400*b*).

In an embodiment of a method of manufacturing the display device 1000, heat compression may be applied to mount the driving units 500 and 600 to the second surface 20 of the substrate 110. Heat generated during the heat compression may be transmitted to the pixels PX of the display area DA or to the driving circuits such as the driving units 400*a* and 400*b* which are at the first surface 10 of the substrate 110, such that electrical elements which are at the first surface 10 (e.g., the plurality of transistors Q, the display elements, and the gate driving circuits, etc.) may be deteriorated and damaged due to the heat.

However, according to one or more embodiment, the cover portion 200 on the second surface 20 of the substrate 110 covers most of the second surface 20 of the substrate 110 except for the planar region at which the driving units 500 and 600 are attached to the wire 140 and/or the wire 150, and may overlap the display area DA and the peripheral area PA (e.g., portions of the peripheral area PA at left and right of the display area DA). The cover portion 200 may transmit heat generated during the heat compression in attachment of the driving units 500 and 600 on the second surface 20 of the substrate 110. Therefore, since the heat generated during the heat compression during mounting of the driving units 500 and 600 on the second surface 20, which is the rear surface of the substrate 110, may be emitted through the cover portion 200 in a direction away from various electrical elements at the first surface 10 (e.g., components of the pixel PX, the driving units 400*a* and 400*b*, etc.), damage or degradation of such electrical elements due to the heat may be reduced or effectively prevented.

An embodiment of a display device 1000 is hereinafter described with reference to FIG. 5 as well as the above-described drawings.

Figure 5:
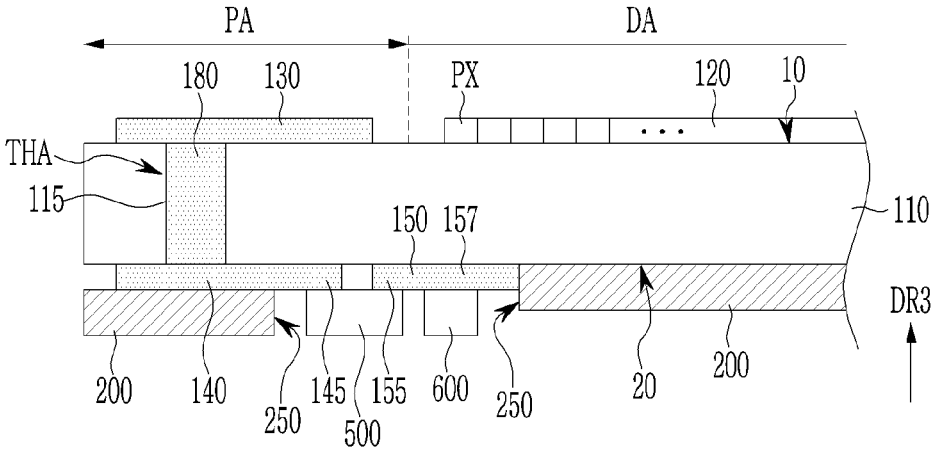
FIG. 5 is a cross-sectional view of an embodiment of an end portion of a display device.

FIG. 5 is an enlarged cross-sectional view of an embodiment of a display device 1000.

Referring to FIG. 5, the display device 1000 is the same as most of the display device 1000 of the above-described embodiment, however, the driving unit 600 may be attached to a portion 157 of the wire 150 to be electrically connected thereto, and an entirety of the driving unit 600 may be within the opening 250 of the cover portion 200 (e.g., does not overlap a solid portion of the cover portion 200 which defines the opening 250). The driving unit 600 may be in a form of a flexible printed circuit film or a driving circuit chip.

According to an embodiment, the wire 150 may be omitted, and in this case, one of the driving unit 500 of the type of the driving circuit chip and/or the driving unit 600 of the type of the flexible printed circuit film, may be attached to the wire 140 at the through part THA.

An embodiment of a manufacturing method of the display device 1000 is described with reference to FIG. 6 to FIG. 9 as well as the above-described drawings. FIG. 6 to FIG. 9 are perspective views of a display device 1000 in an embodiment of a method of manufacturing the display device 1000.

Figure 6:
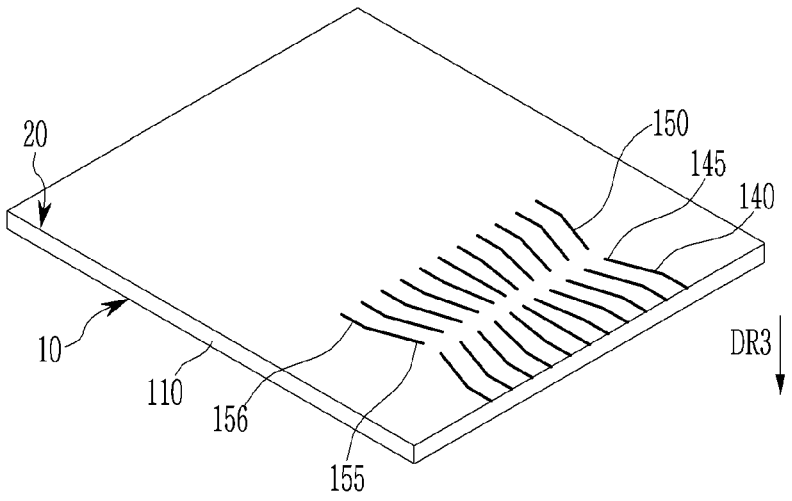
FIG. 6 to FIG. 9 are perspective views of processes in an embodiment of a method of manufacturing a display device.

Referring to FIG. 6 along with FIG. 1, after providing or forming a plurality of pixels PX, the driving units 400*a* and 400*b*, and the various voltage lines and signal lines on the first surface 10 which is the front surface of the substrate 110, the wires 140 and 150 are provided or formed on the second surface 20 which is the rear surface of the substrate 110. The wire 140 may include a first end 145, and the wire 150 may include a first end 155 and a second end 156 which is opposite to the first end 155. The wire 140 may be electrically connected to the various voltage lines and signal lines on the first surface 10 of the substrate 110, through the through part THA of the substrate 110 as above-described.

Figure 7:
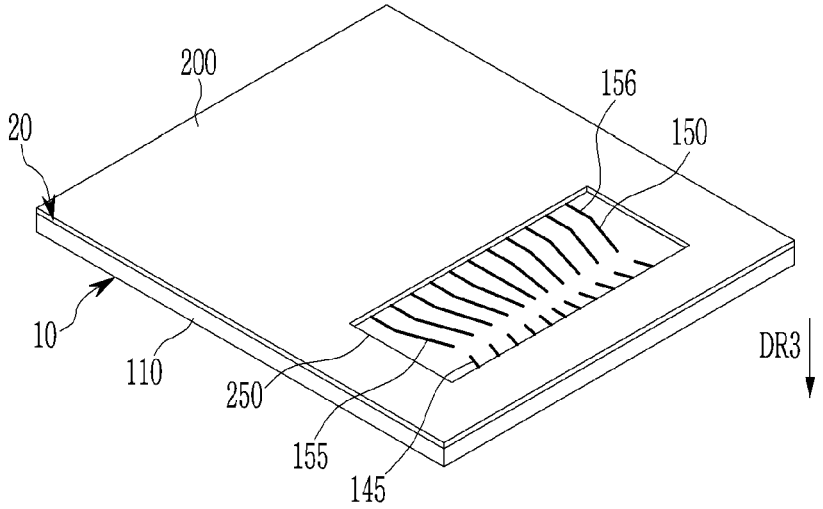

Referring to FIG. 7, the cover portion 200 having the opening 250 is attached to the substrate 110 at the second surface 20 of the substrate 110. In this case, the first end 145 of the wire 140, and the first end 155 and the second end 156 of the wire 150 may each be exposed to outside the cover portion 200 at the opening 250. As described above, in an embodiment, the wire 150 may be omitted. That is, the cover portion 200 which is attachable to the substrate 110 at the second surface 20, disposes a portion of the wire 140 and a portion of the wire 150 exposed to outside the cover portion 200 at the opening 250.

Figure 8:
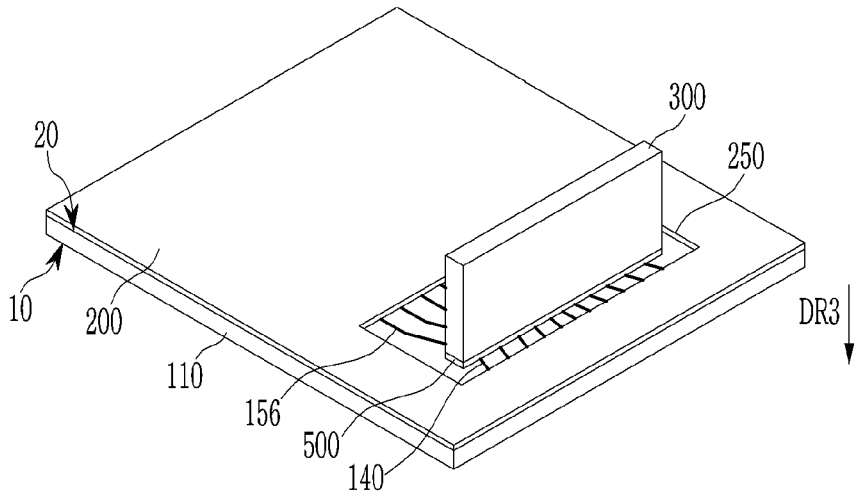

Referring to FIG. 8, the driving units 500 are aligned with the first end 145 and the first end 155 of the wires 140 and 150 which are exposed to outside the cover portion 200 at the opening 250 of the cover portion 200. Compression is applied, such as by using a compression device 300, to mount the driving unit 500 to the substrate 110 at the second surface 20 of the substrate 110. At this time, a heat compression process may be performed.

Figure 9:
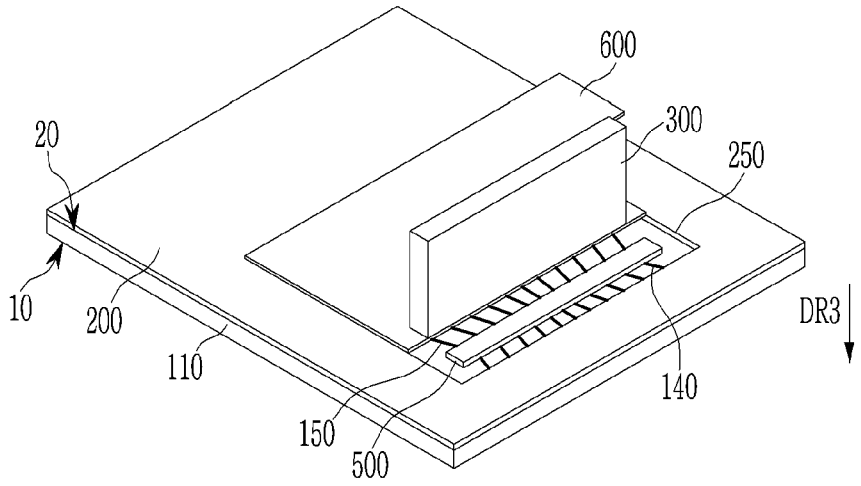

Referring to FIG. 9, the driving unit 600 is aligned with the second end 156 or the portion of the wire 150 which is exposed to outside the cover portion 200 at the opening 250 of the cover portion 200. Compression is applied, such as by using the compression device 300, to mount the driving unit 600 to the substrate 110 at the second surface 20 of the substrate 110. At this time, the heat compression process may be performed.

When the heat compression process is performed, since heat generated during heat compressing of the driving units 500 and 600 at the second surface 20 which is the rear surface of the substrate 110 is discharged by the cover portion 200 as above-described, damage to the display element of the pixel PX of the display device 1000 or the electrical elements of the driving circuit such as the driving units 400*a* and 400*b* at the first surface 10 of the substrate 110, from the heat, may be reduced or effectively prevented.

A display device 1000*a* and a display device 1000*b* are described with reference to FIG. 10 and FIG. 11 along with FIG. 1 to FIG. 5 above-described.

Figure 10:
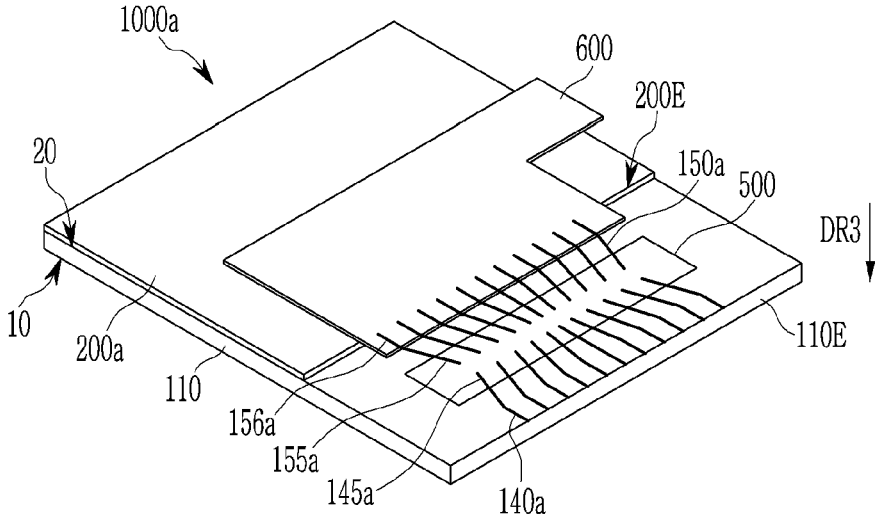
FIG. 10 and FIG. 11 are perspective views of embodiments of a display device.
Figure 11:
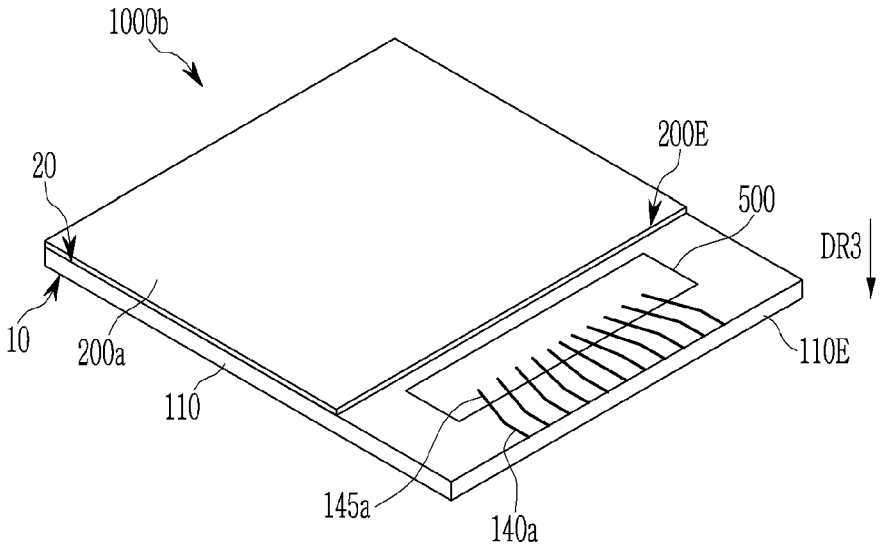

FIG. 10 and FIG. 11 are perspective views of an embodiment of a display device 1000*a*.

Since the display device 1000*a* is substantially the same as the display device 1000 of the above-described embodiment, differences are mainly described.

Referring to FIG. 10, the wire 140*a* and wire 150*a* included in a display panel 100 of the display device 1000*a* are the same as the wire 140 and the wire 150 of the above-described embodiment. However, the wire 140*a* and wire 150*a* may be disposed closer to the edge 110E of the substrate 110 than the wire 140 and the wire 150.

A cover portion 200*a* is substantially the same as the cover portion 200 described above, except the cover portion 200*a* defines an edge 200E spaced apart from the edge 110E of the substrate 110. Portions of the wire 140*a* and the wire 150*a* are exposed to outside the cover portion 200*a* at the edge 200E. The edge 200E of the cover portion 200*a* faces the edge 110E of the substrate 110, with the portions of the wire 140*a* and the wire 150*a* therebetween. The cover portion 200*a* according to the present embodiment may not have the same opening 250 as the above-described embodiment. That is, the cover portion 200*a* according to the present embodiment may be continuously provided or formed as a solid portion along a direction, without a hole or opening 250 defined therein.

The driving unit 500 is attached a first end 145*a* and a first end 155*a* of the wires 140*a* and 150*a*, respectively, that are not covered by the cover portion 200*a* and are exposed outside thereof to be electrically connected to the driving unit 500. The driving unit 600 may be attached and electrically connected to a second end 156*a* of the wire 150*a* that is not covered by the cover portion 200*a* and is exposed to outside thereof. In FIG. 10, the driving unit 500 is illustrated as transparent for convenience of description and understanding.

The cover portion 200*a* may not be disposed between the driving unit 500 and the edge 110E of the substrate 110 in a plan view of the rear side of the display device 1000*a*. More specifically, unlike the cover portion 200 described above, the edge 200E of the cover portion 200*a* may or may not be aligned with the edge 110E of the substrate 110 at the end portion of the display device 1000*a*. Accordingly, a total planar area of the cover portion 200*a* may be smaller than the total planar area of the substrate 110. In an embodiment, the driving unit 500 may be a driving circuit chip, and an entirety of the driving circuit chip may be between the side surface 100E of the substrate 110 and the edge 200E of the cover portion 200*a*.

According to the present embodiment, in addition to the effects according to the above-described embodiment, a separate opening in the cover portion 200*a* is excluded, so that the process in a method of manufacturing the display device 1000*a* may be simplified. In addition, since the portion at which the driving units 500 and 600 are attached to the wires 140*a* and 150*a* is disposed closer to the edge 110E of the substrate 110, the portion at which the driving units 500 and 600 are attached to the wires 140*a* and 150*a* may be spaced further away from the display area DA and the driving circuits such as the driving units 400*a* and 400*b*. Accordingly, in an embodiment of a method of manufacturing the display device 1000*a*, a risk that heat generated during the heating compressing when mounting the driving units 500 and 600 on the second surface 20 of the substrate 110 is transmitted to the display element of the pixel PX of the display area DA or the driving circuit such as the driving units 400*a* and 400*b*, may be further reduced.

Referring to FIG. 11, the display device 1000*b* is substantially the same as most of the display device 1000*a* illustrated in FIG. 10, but the wire 150*a* and the driving unit 600 are omitted. Since the effects of the display device 1000*b* are the same as described above, the description thereof is omitted.

While this invention has been described in connection with what is presently considered to be practical embodiments, it is to be understood that the invention is not limited to the disclosed embodiments. On the contrary, it is intended to cover various modifications and equivalent arrangements included within the spirit and scope of the appended claims.

What is claimed is:

1. A display device comprising:

a substrate including a first surface and a second surface opposing each other along a thickness direction of the substrate;

a display element and a signal line on the first surface;

a first wire extended along the second surface and electrically connected to the signal line;

a cover portion extended along the second surface; and a first driving unit on the second surface and electrically connected to the first wire, wherein the first wire which is extended along the second surface of the substrate is between the second surface and the cover portion and defines a portion exposed outside the cover portion, and the first driving unit is connected to the first wire at the portion of the first wire which is exposed outside the cover portion.

2. The display device of claim 1, wherein the cover portion includes a plurality of layers and an adhesive layer which is between the plurality of layers.

3. The display device of claim 2, wherein the plurality of layers includes a heat dissipation layer.

4. The display device of claim 3, wherein the heat dissipation layer includes copper or graphite.

5. The display device of claim 4, wherein the adhesive layer includes an outer surface which is closest to the substrate and has an embossed shape.

6. The display device of claim 1, wherein the substrate further includes:

a display area in which the display element is provided, and a peripheral area adjacent to the display area and in which the signal line is provided, and the cover portion corresponds to both the display area and the peripheral area.

7. The display device of claim 6, further comprising an enclosed opening defined in the cover portion, wherein the portion of the first wire is exposed outside the cover portion at the enclosed opening in the cover portion.

8. The display device of claim 7, wherein the enclosed opening in the cover portion has a planar size defined along the second surface of the substrate, the first driving unit includes a driving circuit chip which has a planar size smaller than the planar size of the enclosed opening, and the driving circuit chip is disposed in the enclosed opening of the cover portion.

9. The display device of claim 6, wherein the substrate further includes a side surface which connects the first surface to the second surface, and in a direction along the second surface of the substrate, the cover portion includes an edge which is spaced apart from the side surface of the substrate with the portion of the first wire therebetween.

10. The display device of claim 9, wherein the first driving unit is a driving circuit chip, and in the direction along the second surface of the substrate, an entirety of the driving circuit chip is between the side surface of the substrate and the edge of the cover portion.

11. The display device of claim 1, further comprising:

a second wire on the second surface and spaced apart from the first wire; and a second driving unit on the second surface and electrically connected to the second wire, wherein the second wire includes a portion exposed outside the cover portion, and the second driving unit is connected to the second wire at the portion of the second wire which is exposed outside the cover portion.

12. The display device of claim 11, wherein the second driving unit is a flexible printed circuit film.

13. The display device of claim 12, further comprising an enclosed opening defined in the cover portion, wherein the portion of the second wire is exposed outside the cover portion at the enclosed opening in the cover portion, a portion of the second driving unit is disposed in the enclosed opening of the cover portion, and within the enclosed opening, the second driving unit is attached to the portion of the second wire.

14. The display device of claim 13, wherein the portion of the second driving unit extends out of the enclosed opening to overlap the cover portion.

15. The display device of claim 12, wherein the substrate further includes a side surface which connects the first surface to the second surface, and in a direction along the second surface of the substrate, the cover portion includes an edge which is spaced apart from the side surface of the substrate with the portion of the first wire and the portion of the second wire therebetween.

16. The display device of claim 1, wherein the substrate further includes:

a display area in which the display element is provided, a peripheral area adjacent to the display area and in which the signal line is provided, and an end portion of the peripheral area in which an opening in the substrate is defined, and the first wire is electrically connected to the signal line at the opening in the substrate at the end portion of the peripheral area.

17. A display device comprising:

a substrate including a first surface and a second surface opposing each other along a thickness direction of the substrate;

a light-emitting element and a signal line on the first surface;

a first wire extended along the second surface and electrically connected to the signal line;

a cover portion extended along the second surface and corresponding to the light-emitting element on the first surface; and a first driving unit on the second surface and electrically connected to the first wire, wherein the first wire which is extended along the second surface of the substrate is between the second surface and the cover portion and defines a portion exposed outside the cover portion, and the first driving unit is connected to the first wire at the portion of the first wire which is exposed outside the cover portion.

18. The display device of claim 17, further comprising an enclosed opening defined in the cover portion, wherein the portion of the first wire is exposed outside the cover portion at the enclosed opening in the cover portion.

19. The display device of claim 17, wherein the substrate further includes a side surface which connects the first surface to the second surface, and in a direction along the second surface of the substrate, the cover portion includes an edge which is spaced apart from the side surface of the substrate with the portion of the first wire therebetween.

20. A display device comprising:

a substrate including a first surface and a second surface opposing each other;

a light-emitting element and a signal line on the first surface;

a first wire extended along the second surface and electrically connected to the signal line;

a cover portion extended along the second surface, the cover portion including copper or graphite; and a first driving unit on the second surface and electrically connected to the first wire, wherein the first wire which is extended along the second surface of the substrate is between the second surface and the cover portion and defines includes a portion exposed outside the cover portion including copper or graphite, and the first driving unit is connected to the first wire at the portion of the first wire which is exposed outside the cover portion including copper or graphite.

* * * * *